US010086523B2

(12) United States Patent
Rodriguez, Jr. et al.

(10) Patent No.: US 10,086,523 B2
(45) Date of Patent: Oct. 2, 2018

(54) ADJUSTABLE SLICER

(71) Applicants: Paul Roman Rodriguez, Jr., Rockville Centre, NY (US); James Oscar Rodriguez, Rockville Centre, NY (US)

(72) Inventors: Paul Roman Rodriguez, Jr., Rockville Centre, NY (US); James Oscar Rodriguez, Rockville Centre, NY (US)

( * ) Notice: Subject to any disclaimer, the term of this patent is extended or adjusted under 35 U.S.C. 154(b) by 0 days.

(21) Appl. No.: 15/295,419

(22) Filed: Oct. 17, 2016

(65) Prior Publication Data

US 2018/0104836 A1 Apr. 19, 2018

(51) Int. Cl.
*B26B 29/06* (2006.01)

(52) U.S. Cl.
CPC ..... *B26B 29/063* (2013.01)

(58) Field of Classification Search
CPC . B26B 29/063; B26B 29/06; B26B 2029/066; F16H 25/2056; F16H 2025/2059
See application file for complete search history.

(56) References Cited

U.S. PATENT DOCUMENTS 1,098,941 A * 6/1914 Collins ..... B26B 29/063 83/454
2,487,642 A 11/1949 Waltoff ..... 222/390
3,612,325 A 10/1971 Williams ..... 215/40
5,881,979 A * 3/1999 Rozier, Jr. ..... A47B 91/024 248/188.4
6,856,750 B2 * 2/2005 Chang ..... G02B 6/266 359/234
7,216,574 B2 5/2007 Woods ..... 83/397
7,419,066 B1 9/2008 Ewers ..... 220/303
7,484,641 B2 2/2009 Casale et al. ..... 222/83.5
7,621,207 B2 11/2009 Botsai et al. ..... 83/698.11
8,474,359 B2 7/2013 George ..... 83/745
8,777,140 B2 7/2014 Beber et al. ..... 241/92
9,050,734 B2 6/2015 Mazursky et al. ..... 101/26
(Continued)

*Primary Examiner* — Stephen Choi
(74) *Attorney, Agent, or Firm* — Stein IP, LLC

(57) ABSTRACT

An adjustable cutting device includes a base including a base support component for supporting an object for slicing a cutter support for supporting and guiding a cutter tool such as a knife and a base for supporting an object for slicing or cutting and an upper component including a cover. The base includes a threaded base cylinder, fixed to the base support component. The threaded base cylinder having an external thread. The cutter support is movable relative to the base; the cutter support comprising first and second frame like elements separated by a fixed region, surfaces of the first and second elements adjacent the region formed for supporting and guiding a cutter tool such as a knife. The cutter support also includes an internally threaded cutter cylinder fixed to the cutter support. The upper component includes a cover hinged for overlying said cutter support and including a threaded cover cylinder rotatable relative to the cover, said cover cylinder having both internal and external threads, the external thread of the cover cylinder with a pitch matching the pitch of the cutter cylinder's internal thread, the internal threads of the cover cylinder having a pitch matching the pitch of the base cylinder. The pitch of the internal and external threads of the cover cylinder are different.

13 Claims, 5 Drawing Sheets

(56) References Cited

U.S. PATENT DOCUMENTS

| | | | | |
|---|---|---|---|---|
| 2005/0199115 | A1 | 9/2005 | Veltrop et al. | 83/599 |
| 2005/0242113 | A1 | 11/2005 | Weist | 222/83.5 |
| 2009/0047886 | A1 | 2/2009 | O'Neil | 452/160 |
| 2009/0208625 | A1 | 8/2009 | Slevkoff et al. | 426/518 |
| 2011/0155687 | A1 | 6/2011 | Ammann | 215/252 |
| 2012/0031250 | A1 | 2/2012 | Hocker | 83/821 |
| 2012/0042762 | A1 | 2/2012 | Umholtz et al. | 83/452 |
| 2016/0297088 | A1* | 10/2016 | Slutsky | B26B 29/063 |

* cited by examiner

ADJUSTABLE SLICER

CROSS-REFERENCE TO RELATED APPLICATIONS

This application is a Non-Provisional of U.S. Provisional Application No. 62/243,052 filed on Oct. 17, 2015. All disclosures of the document named above are incorporated herein by reference.

BACKGROUND

Many advances have been made in cutting implements including cutting implements used in food preparation. Nevertheless, a problem still remains in adjusting a cutting tool to account for the varying sizes of foods. One example is the grape cutter of U.S. Pat. No. 8,474,359. The grape cutter defines a cutting region for allowing a knife to be drawn through the region for cutting food. While the grape cutter of the '359 patent is capable of adjusting for variations in the size of the food to be cut, the size adjustment does not give the user assistance in locating the knife or other cutting tool to be used in the cutting operation.

SUMMARY OF THE INVENTION

The invention overcomes the foregoing and other problems by providing an adjustable cutting device including a base and cover for securing food for cutting. Located between the base and cover is a cutter support which is movable relative to the base and includes first and second elements separated by a fixed region; surfaces of the first and second elements adjacent the region are formed for supporting and guiding a cutting tool. The cover overlays the cutter support and is part of an upper component which is also movable relative to the base. The motion of the cutter support and the upper component is governed by the interaction of threaded cylinders which are part of the base, cutter support and upper component. Fixed to the base is a base cylinder which has an external thread. Fixed to the cutter support is a threaded cutter cylinder with an internal thread. The upper component includes a cover cylinder rotatable with respect to the upper component with internal and external threads. The diameter of the cover cylinder is selected so that it will pass within the interior of the cutter cylinder. The external threads of the cover cylinder has a pitch matching the pitch of the threads on the cutter cylinder. The internal threads of the cover cylinder has a pitch matching the pitch of the threads on the base cylinder. The base cylinder has a diameter allowing the external threads to engage the internal threads of the cover cylinder. The pitch of the internal and external threads of the cover cylinder are different and the pitch of the internal threads has a larger pitch than the external threads. The ratio of the pitch of the internal and external threads on the cover cylinder determines the relation between the motion of the cover and cutter support relative to the base. For example, if that ratio is 2:1 then the cover rises or falls twice as far as the cutter support does for any given rotation. In other words, as the cover and cutter support move relative to the base, when this ratio is 2:1 the cutter support and its first and second elements remain exactly halfway between the base and cover so that any food located in that region will be cut in half by a cutting tool located between the two elements of the cutter support. Similarly, if the thread pitch ratio is 3:1, then the cutter support will remain ⅓ of the distance between base and cover as these parts move up or down, and so on.

Thus in one aspect the invention provides:

An adjustable cutting device comprising:

a base including a base support component for supporting an object for slicing, said base including a threaded base cylinder, fixed to the base support component, said threaded base cylinder having an external thread, a cutter support, movable relative to said base, said cutter support comprising first and second elements separated by a fixed region, surfaces of the first and second elements adjacent the region are formed for supporting and guiding a cutter tool, an internally threaded cutter cylinder fixed to said cutter support, said cutter cylinder having an internal thread, and an upper component including a cover for overlying said cutter support and including a threaded cover cylinder rotatable relative to the cover, said cover cylinder having both internal and external threads, the cover cylinder's external threads with a pitch matching the pitch of the cutter cylinder's internal thread and the internal threads of the cover cylinder having a pitch matching the pitch of the base cylinder, wherein the pitch of the internal and external threads of the cover cylinder are different.

The foregoing describes operation of the adjustable slicer with the cover component of the upper component arranged to overly the object being sliced. However, the cover is hinged to allow it to be rotated out of position overlying the object being sliced. With the cover in this rotated or open position the cutter support may be adjusted to take on any height from the base allowing a cut to be addressed at any point of the object being sliced.

DETAILED DESCRIPTION OF THE DRAWINGS

Figure 3:
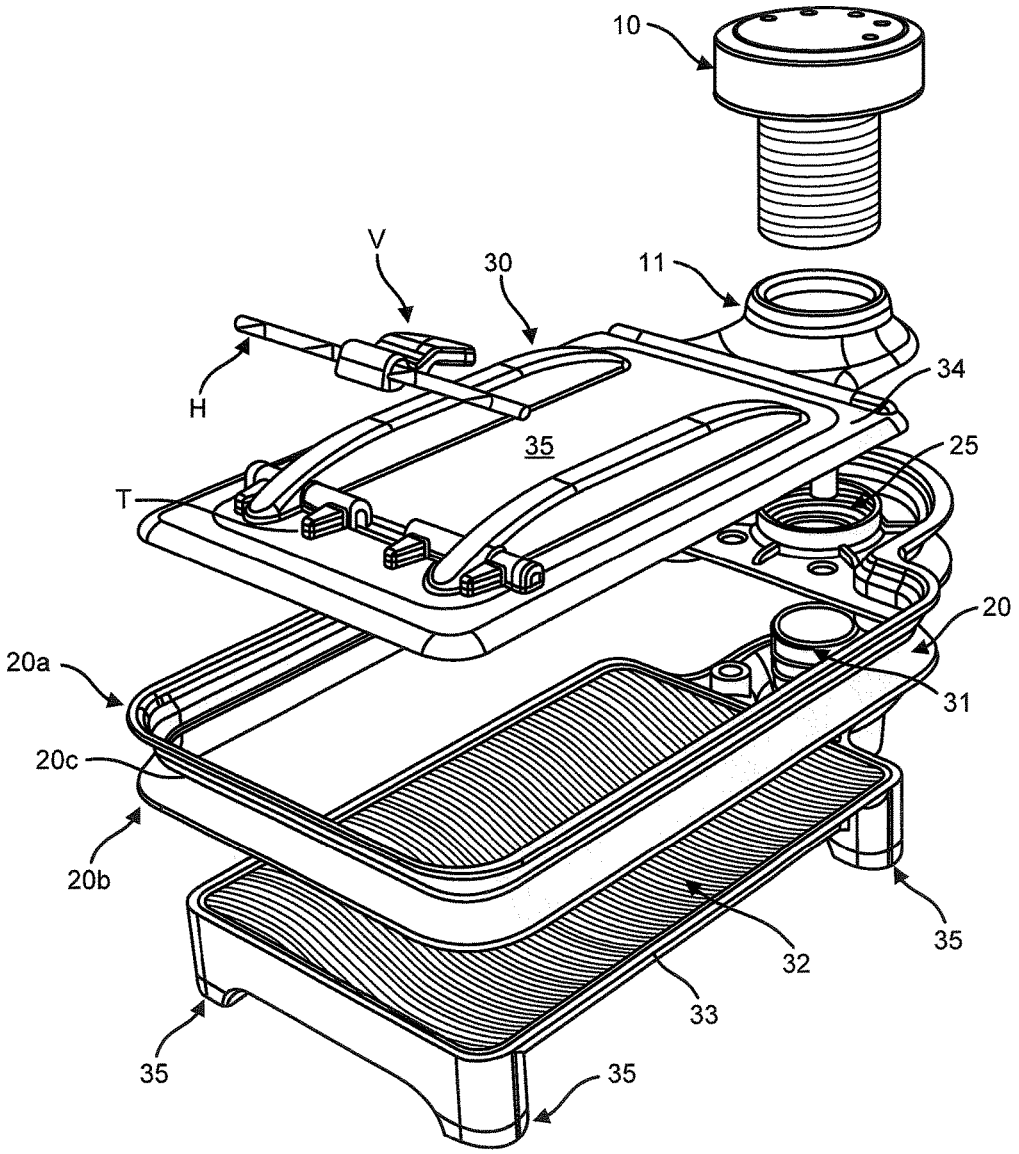
FIG. 3 is an exploded view of the interaction of the components

FIG. 3 shows the base component 32 which includes a generally planar food support 33 and spaced legs 35. A base cylinder 31 is fixed, through a collar (see FIG. 4) to the base 32. The base cylinder 31 has external threads. An axis of the base cylinder is perpendicular to a major plane of the food support 33. A cutter support 20 includes elements 20*a* and 20*b*, which are spaced apart to define a fixed region 20*c* therebetween. As seen in FIG. 3 the elements 20*a* and 20*b* are open frames which are maintained in a fixed spaced relation to each other. The facing edges of the elements 20*a* and 20*b* are designed and spaced apart to support a cutting tool, such as a knife, as it is moved from one end of the cutter support 20 to the other. The cutter support elements 20*a* and 20*b* illustrated in FIG. 3 each have the form of an open frame allowing the food to be cut to extend from the base component upwards past the cutter support 20. Fixed to the elements 20*a* and 20*b* is a cutter cylinder 25. The cutter cylinder has an axis which is generally perpendicular to a major plane of the elements 20*a* and 20*b*. The third major component is the upper component including a cover 30, a rotatable threaded cover cylinder 10 and a support 11 to support the cover cylinder. The cover cylinder 10 has an axis which is generally perpendicular to a plane defined by the edges of the cover 34.

Figure 1:
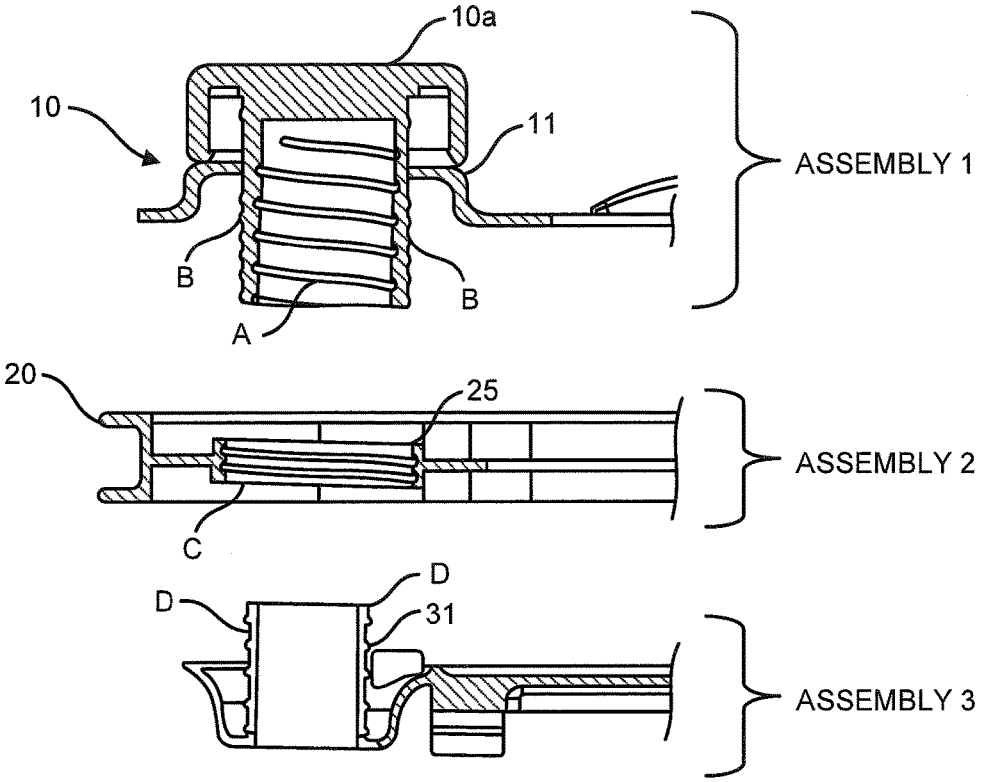
FIGS. 1 and 2 are cross-sections showing the interaction among the threaded cylinders which are components of the base, cutter support and the upper component.
Figure 2:
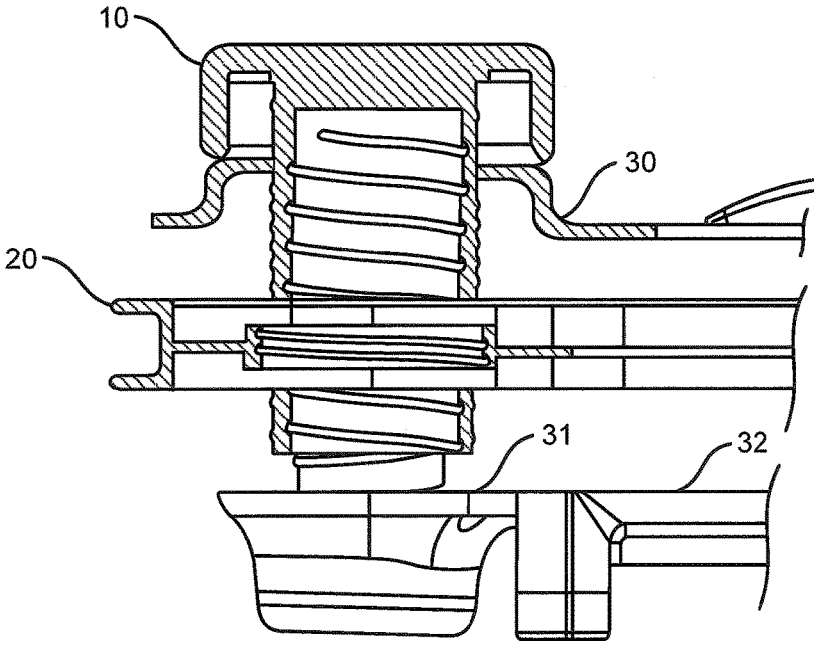

FIG. 1 shows cross sections of the cover cylinder and adjacent structures (noted as Assembly 1), the cutter support cylinder and adjacent structures (noted as Assembly 2) and the base cylinder and associated structures (noted as Assembly 3). Assembly 1 includes the cover cylinder 10 with the external threads B and internal threads A. The cover cylinder is journaled in the cover and has a knob 10*a* which allows a user to rotate the cylinder clockwise or counterclockwise to raise or lower the cover and cutter support relative to the base. Assembly 2 includes the cutter support 20 which supports the cutter support cylinder 25 which includes internal threads C. Assembly 3 comprises the base cylinder D which includes external threads D and the supporting base as illustrated. FIG. 2 is a cross section showing the cylinders 10, 25 and 31 assembled in operative relationship. To assemble the cutter support 20, upper component and cover 30, the external threads B of the cover cylinder 10 are threaded into the inner threads C of the cutter support cylinder 25. The cover cylinder 10 is rotated so the distal end of the cover cylinder 10 is rotated through the cutter support cylinder 25. As the cover cylinder 10 continues its rotation, more and more of the cover cylinder protrude past the cutter support cylinder 25 and cutter support 20. Eventually the distal end of the cover cylinder 10 may then be engaged with the threads D of the base cylinder 31. If the cover cylinder 10 continues to be rotated the cutter support cylinder 25 (and the cutter support 20) will move down to rest on the base cylinder 31. This a storage position of the adjustable cutting device with the cutter support resting on the base 32 and the cover 30 resting on the cutter support 20. From this position the cover cylinder can be rotated by rotating the knob 10*a* to raise the cover and cutter support to an operating position.

Figure 4:
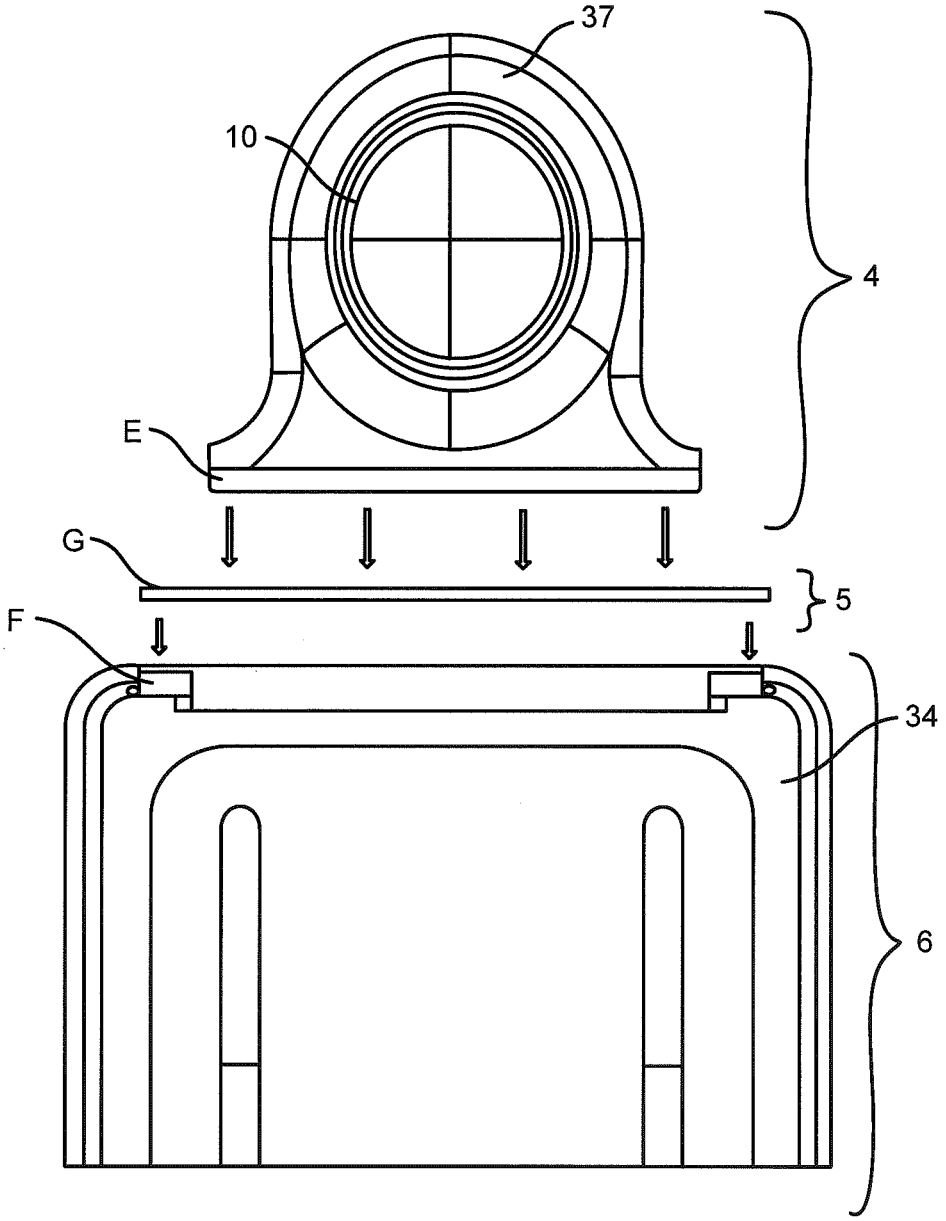
FIG. 4 is a detail plan view showing the interaction among the components of the cutter support.
Figure 6:
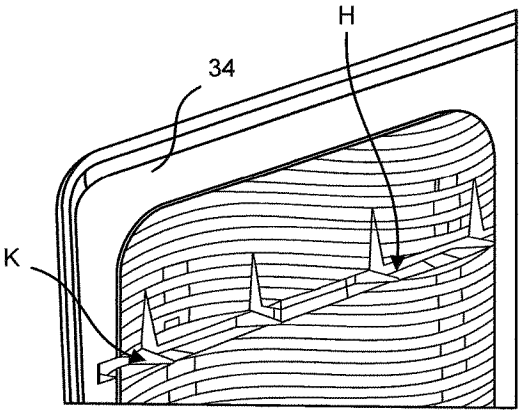
FIGS. 5-7 are plan views of components of the cover element of the upper component.
Figure 5:
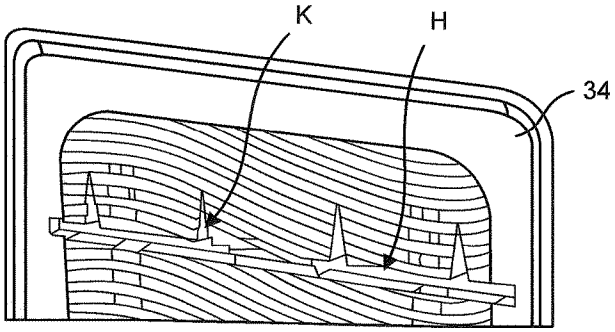
Figure 7:
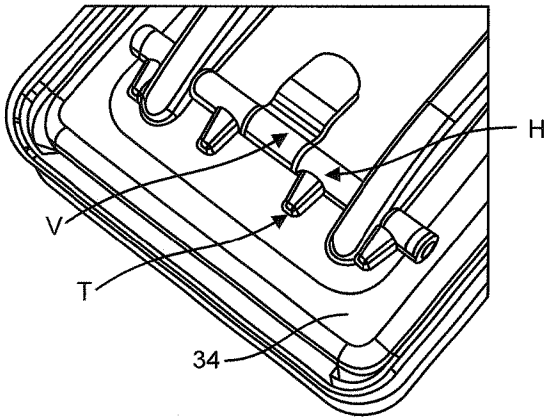
Figure 9:
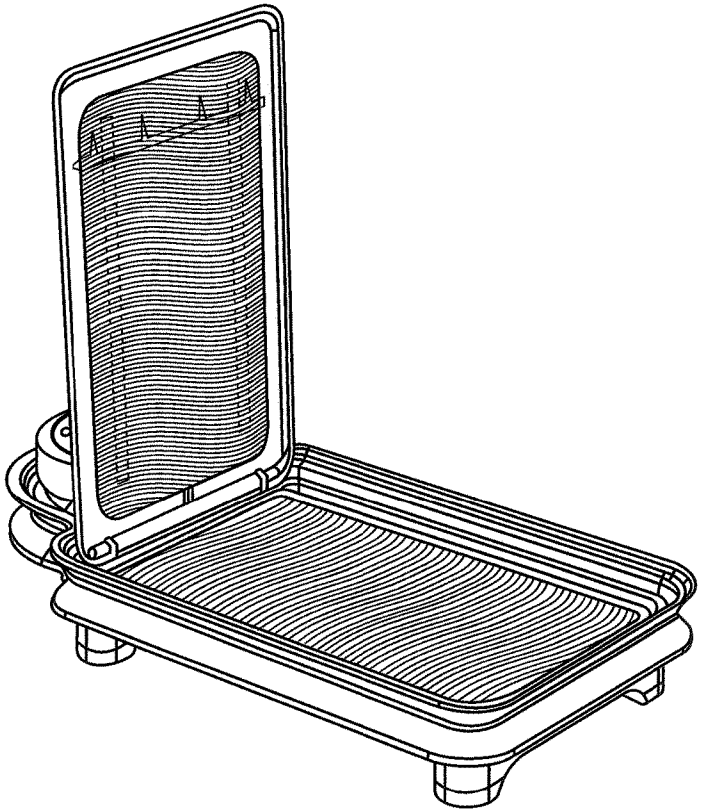
FIGS. 8-9 are isometric views of the adjustable cutting device in closed and open conditions.
Figure 8:
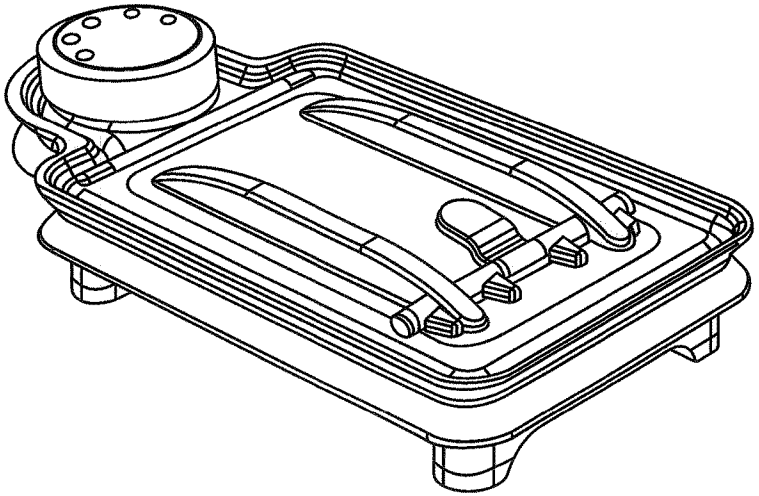

FIG. 4 is a plan view of components of the upper component, cover 30 and its relation to the cover cylinder 10. FIG. 4 shows the cylinder 10 supported in a frame 37. The frame 37 includes a hollow enclosure E which extends across the frame 37. A rod G is supported within the hollow enclosure E and extends beyond the extent of the enclosure E. A cover portion 34 of the upper component is generally planar (although the shape may depart from strictly planar) and includes a pair of recesses F which are spaced from each other by a distance which is less than the length of the rod G. The ends of the rod G are journaled within the recesses F so the rod G functions as an axle. This restricts the motion of the cover portion to rotation about the axis formed by the axle G.

FIGS. 3 and 5-7 show a spike mechanism secured on the cover portion 34. That mechanism includes a rod H on which are secured spikes K. While FIG. 3 shows the rod H above the cover portion 34, that is only for the illustration. The rod H is secured in the casing T. The casing T is located on the cover portion 34 adjacent the transparent region 35 so that when the spiked rod H is rotated into use, the spikes K may engage the food to be cut. A lever V allows the user to rotate the spiked rod H into and out of use. The region 35 of the cover portion 34 represents a transparent portion of the cover allowing the user to maintain visibility of the workpiece being cut. As is apparent from FIGS. 5 and 6, while the lever V is available to the user (i.e., above the cover portion 34) the spikes K lie below the cover portion 34 to engage the food being sliced. While FIGS. 3 and 5-7 show spikes, the form of the mechanism can vary to include a "cheese grater" or a pattern of blunt raised protrusions which can perform a gripping function.

FIGS. 3, 5, 6 and 9 show surfaces which appear "striped". This illustration represents a textured surface which assists in securing the food or other workpiece from unwanted motion during a cutting operation.

As noted there are two different thread pitches in the components of the slicer. One pitch is common among the external thread of the cover cylinder B and the cutter support cylinder's internal thread C. The other pitch is found on the internal threads A of the cover cylinder and the pitch of the external threads D of the base cylinder. In one preferred embodiment the ratio of these pitches is 2:1 so, from a position where the cutter support is directly contacting the base and the cover is directly contacting the cutter support, as the knob 10 is rotated the cover rises twice as fast as the cutter support. Thus at every position of the components any food located between cover and base will be sliced in half since the cutter support will remain halfway between cover and base. Obviously with a ratio less than 2:1 but more than 1:1 the cutter support will be closer to the cover than the base and with a ratio greater than 2:1 the cutter support will be closer to the base than the cover. Preferably the ratio is no smaller than 1:1 nor larger than 10:1.

Referring again to FIGS. 3 and 4, note that cover 34 can be rotated about the axle G so the cover 34 no longer overlies the region occupied by the object to be sliced. In this configuration the user is free to position the cutter support 20 at any height above the base. This allows the user complete freedom to direct the slice at any height from the base.

The components of the slicer can be made of a variety of different materials. The threaded parts may be molded plastic, silicone, rubber or metal such as stainless steel. The support surfaces, cutting guide and cover, as well as the feet 35, may be made of molded plastic, TPR, silicone or metal such as stainless steel. While some parts may be metal and other parts may be plastic or rubber, it is also possible to make the entire device either plastic or metal.

What I desire to claim is:

1. An adjustable cutting device comprising:

a base including a base support component for supporting an object for slicing, said base including a threaded base cylinder, fixed to the base support component, said threaded base cylinder having an external thread, a cutter support, movable relative to said base, said cutter support comprising first and second elements separated by a fixed region, surfaces of the first and second elements adjacent the region formed for supporting and guiding a cutter tool, an internally threaded cutter cylinder fixed to said cutter support, and an upper component including a cover for overlying said cutter support and including a threaded cover cylinder rotatable relative to the cover, said cover cylinder having both internal and external threads, the external thread of the cover cylinder with a pitch matching the pitch of the cutter cylinder's internal thread, the internal threads of the cover cylinder having a pitch matching a pitch of the base cylinder, the external thread of the cover cylinder engaging the cutter cylinder's internal thread and the internal thread of the cover cylinder engaging the external thread of the base cylinder, wherein the pitch of the internal and external threads of the cover cylinder are different.

2. The cutting device of claim 1 wherein the pitch of the external threads and internal threads of the cover cylinder have a ratio greater than 2:1 but less than 10:1.

3. The cutting device of claim 1 wherein the pitch of the external threads and internal threads of the cover cylinder have a ratio of 2.

4. The cutting device of claim 1 wherein the pitch of the external threads and internal threads of the cover cylinder have a ratio less than 2:1 and greater than 1:1.

5. The cutting device of claim 1 wherein the threaded base cylinder has an axis which is perpendicular to a plane of the support component.

6. The cutting device of claim 5 wherein the threaded cutter cylinder is located between the first and second elements with an axis perpendicular to a plane of at least one of the elements.

7. The cutting device of claim 6 wherein threaded cover cylinder has an axis perpendicular to a major plane of the cover.

8. The cutting device of claim 3 in which the upper component includes a shaft supported for rotation along which shaft food engaging spikes are disposed.

9. The cutting device of claim 8 wherein the shaft has a position in which the spike are not engagable and another position in which the spikes are engagable with an object for slicing.

10. The cutting device of claim 1 wherein the cover of the upper component is hinged allowing the cover to be rotated to lie non-parallel to said base support component.

11. The cutting device of claim 1 wherein rotation of the cover cylinder produces motion of both the cutter support and the cover.

12. The cutting device of claim 11 wherein an extent of motion of the cutter support and cover depends on the pitch of threads on cover cylinder, cutter cylinder and base cylinder.

13. The cutting device of claim 11 wherein the pitch of the external threads and internal threads of the cover cylinder have a ratio greater than 2:1 but less than 10:1.

* * * * *